United States Patent [19]

Masukawa et al.

[11] Patent Number: 4,584,267

[45] Date of Patent: Apr. 22, 1986

[54] THERMALLY DEVELOPABLE, LIGHT-SENSITIVE MATERIAL

[75] Inventors: Toyoaki Masukawa, Hinode; Kunihiro Koshizuka, Hino, both of Japan

[73] Assignee: Konishiroku Photo Industry Co., Ltd., Tokyo, Japan

[21] Appl. No.: 650,815

[22] Filed: Sep. 13, 1984

[30] Foreign Application Priority Data

Sep. 16, 1983 [JP] Japan ..... 58-169321

[51] Int. Cl.[4] ..... G03C 1/02

[52] U.S. Cl. ..... 430/619; 430/628; 430/203; 430/620

[58] Field of Search ..... 430/203, 617, 619, 620, 430/628

[56] References Cited

U.S. PATENT DOCUMENTS

| | | | |
|---|---|---|---|
| 3,561,967 | 2/1971 | Sakai et al. | 430/628 |
| 3,637,394 | 1/1972 | Smith et al. | 430/628 |
| 4,152,160 | 5/1979 | Ikenoue et al. | 430/620 |

*Primary Examiner*—Won H. Louie

*Attorney, Agent, or Firm*—Jordan B. Bierman

[57] ABSTRACT

A thermally developable, light-sensitive material is disclosed which has at least one thermally developable, light-sensitive layer formed on a support which contains (a) a light-sensitive silver halide, (b) an organic silver salt, (c) a reducing agent and (d) a binder. Said binder contains gelatin and/or a gelatin derivative and a poly(vinyl alcohol) having a viscosity average polymerization degree of not more than 700.

6 Claims, No Drawings

THERMALLY DEVELOPABLE, LIGHT-SENSITIVE MATERIAL

FIELD OF THE INVENTION

The present invention relates to a thermally developable, light-sensitive material, and more particularly, to a thermally developable, color light-sensitive material having high developability and good heat diffusion transferability.

BACKGROUND OF THE INVENTION

While many compounds have been proposed for use as binders in thermally developable, light-sensitive materials, hydrophobic poly(vinyl butyral) is used most commonly. Techniques of using water-soluble binders are also known; thermally developable, light-sensitive materials using gelatin as the binder are shown in Japanese Patent Application (OPI) Nos. 52626/1974 and 116144/1978 (the symbol OPI as used herein means an unexamined published Japanese Patent Application), U.S. Pat. No. 4,168,980, Japanese Patent Publication Nos. 26582/1969, 12700/1970 and 18416/1970, whereas the use of poly(vinyl alcohol) as a binder is shown in Japanese Patent Application (OPI) No. 151138/1975 and Research Disclosure (hereunder referred to as RD) No. 17707. Japanese Patent Application (OPI) No. 28737/1983 shows the use of water-soluble poly(vinyl butyral) as a binder.

One of the major reasons for using these water-soluble binders is to provide a higher sensitivity through the use of a conventional silver halide emulsion Gelatin is considered to be the most advantageous binder because of its setting properties that can be effectively used during its manufacture and application stages. However, gelatin per se has no thermoplasticity and the thermal developability of the light-sensitive material that uses only gelatin as a binder is quite low. In order to solve this problem, techniques of using gelatin in admixture with a polar organic compound such as dimethylurea or acetamide have been proposed in U.S. Pat. Nos. 3,438,776 and 3,667,959, as well as Japanese Patent Application (OPI) Nos. 137321/1977 and 116144/1978. A similar technique is shown in Japanese Patent Application No. 82064/1982 filed by the applicant of subject application. Other references not mentioned here show the technique of using gelatin in combination with other water-soluble polymers.

Thermally developable, color light-sensitive materials are shown in many references. For example, U.S. Pat. Nos. 3,531,286, 3,761,270, 3,764,328, RD Nos. 15108, 15127, 12044 and 16479 show thermally developable, light-sensitive materials of the type that contains both a photographic coupler and a color developing agent; U.S. Pat. No. 3,180,731, RD Nos. 13443 and 14347 show products containing a leuco dye; U.S. Pat. No. 4,235,957, RD Nos. 14433, 14448, 15227, 15776, 18137 and 19419 show products using the silver dye bleaching method; and U.S. Pat. Nos. 4,124,398, 4,124,387 and 4,123,273 show the method of thermally bleaching a heat developable, light-sensitive material.

Thermally developable, color light-sensitive materials of the type that produces a color image by transferring a diffusible dye which has been released or formed by thermal development are shown in Japanese Patent Application (OPI) Nos. 179840/1972, 186744/1982, 19845/1982, 207250/1982 and 0551/1983. Japanese Patent Application No. 129516/1983 shows a thermally developable, color light-sensitive material which contains a compound capable of forming a heat-transferable dye.

For various reasons such as the need for providing a higher sensitivity and for ensuring good process stability, it is advantageous to use silver halide-gelatin emulsions. However, as already pointed out, systems using gelatin as the sole binder do not have high developability, and combining gelatin with a polar organic compound such as dimethylurea or acetamide has been proposed for providing a higher developability. Although some improvement in developability is achieved by this method, the result is not completely satisfactory in respect of the balance between development, coupling reaction (dye formation or its release) and the heat transfer of the dye released or formed.

It is known that the results of development, coupling reaction and the heat transfer of a released or formed dye onto an image-receiving layer can be greatly improved by using a water-soluble binder made of only a thermoplastic polymer such as poly(vinyl alcohol) or water-miscible poly(vinyl butyral) on the condition that silver halide is prepared within the same polymer. Therefore, attempts have been made to mix gelatin with a water-soluble polymer such as poly(vinyl alcohol) or water-miscible poly(vinyl butyral). More specifically, a silver halide-gelatin emulsion is simply mixed with poly(vinyl alcohol) or other water-soluble polymers in an attempt at providing a higher sensitivity without sacrificing the developability and the efficiency of coupling reaction, or at enabling the simultaneous application of multi-layers by making the most of the setting properties of gelatin. However, the desired improvement in the developability and the efficiency of coupling reaction cannot be obtained by simply mixing the water-soluble polymer with gelatin. Poly(vinyl alcohol) and water-soluble poly(vinyl butyral) are generally low in their miscibility with gelatin and have a tendency to form "islands" (aggregates) during mixing with gelatin or when they are being dried. Because of this tendency, the mere mixing of water-soluble polymers with gelatin is not highly effective in providing improved developability and a better efficiency of coupling reaction, and the "islands" prevent the formation of a transferred dye image of good quality.

SUMMARY OF THE INVENTION

Therefore, one object of the present invention is to provide a light-sensitive material that uses a hydrophilic binder and which ensures good thermal developability.

Another object of the present invention is to provide a light-sensitive material capable of efficient thermal development which uses gelatin and/or a gelatin derivative and at least one other hydrophilic polymeric material.

A further object of the present invention is to provide a thermally developable, color light-sensitive material of diffusion transfer type that permits a color providing material to cause an efficient color forming or dye releasing reaction and which ensures a high transfer density of the dye released or formed.

These objects can be achieved by a thermally developable, light-sensitive material having at least one thermally developable, light-sensitive layer formed on a support which contains (a) a light-sensitive silver halide, (b) an organic silver salt, (c) a reducing agent and (d) a binder, said binder containing gelatin and/or a gelatin derivative and a poly(vinyl alcohol) having a viscosity average polymerization degree of not more than 700.

DETAILED DESCRIPTION OF THE INVENTION

Two basic features that characterize poly(vinyl alcohol) are the degree of polymerization and that of saponification. As for the degree of saponification, three groups of poly(vinyl alcohol) are known: one group that is called a completely saponified poly(vinyl alcohol) having 98% or more saponification, the second group that is called a partially saponified poly(vinyl alcohol) having 87–89% saponification, and the final group which is also called partially saponified poly(vinyl alcohol) but has a lower degree of saponification (ca 80%). Poly(vinyl alcohol) compounds are also classified into three groups by the degree of polymerization: the group of low polymerization degree (<500), the group of medium polymerization degree (500–1500) and the group of high polymerization degree (1500–2500). It is known that the degrees of saponification and polymerization have appreciable effects on the water solubility and other properties (especially, film-forming properties) of poly(vinyl alcohol).

The present inventors prepared binder samples by combining gelatin with various types of poly(vinyl alcohol) and examined the color forming property of thermally developable couplers using such binders. As a result, the inventors have found that particularly good results are obtained in respect of development and color formation by using poly(vinyl alcohol)compounds of low polymerization degree, more specifically those having a viscosity average polymerization degree of not more than 700, preferably not more than 500 but not less than 200.

It is not known exactly why only the poly(vinyl alcohol) having the low degree of polymerization in the range defined above provides good results in respect of development and color formation. A probable reason will be that the poly(vinyl alcohol) of low polymerization degree is free from the phase separation from gelatin that usually occurs in the poly(vinyl alcohol) of high polymerization degree. When phase separation occurs between gelatin and poly(vinyl alcohol), the silver halide-gelatin emulsion forms aggregates that severely inhibit its developability. This problem is completely absent from the present invention.

As shown in K. Nagano et al.; "POVAL", new rev. ed. from Kobunshi Kanko-kai, the production of poly(vinyl alcohol) having low polymerization degree requires the preparation of poly(vinyl acetate) of low polymerization degree, and this can be achieved by a conventional technique such as adjusting the solvent concentration or temperature.

The poly(vinyl alcohol) used in the present invention may have any degree of saponification that renders the polymer water-soluble. A saponification of not less than 75% is generally preferred. Poly(vinyl alcohol) contains about 1% of 1,2-glycol bond in the backbone, and as is well known, this bond can be cleaved by treatment with an oxidizing agent such as periodic acid or salts thereof, hydrogen peroxide or hypochlorous acid. Therefore, the poly(vinyl alcohol) of low polymerization degree can also be prepared from poly(vinyl alcohol) of medium to high polymerization degree by the treatment with such oxidizing agents.

According to the present invention, the poly(vinyl alcohol) of low polymerization degree may be replaced by, or used in combination with, a modified poly(vinyl alcohol), particularly those which are modified by either strong or weak acids, or partially acetalized poly(vinyl alcohol).

The degree of polymerization that characterizes the poly(vinyl alcohol) used in the present invention means the viscosity average polymerization degree that is measured by the method specified in JIS K 6726 "Method of Testing Poly(vinyl alcohol)".

The poly (vinyl alcohol) used in the present invention may be available as commercial products, typical examples of which are listed below.

<Commercial poly(vinyl alcohol) compounds)>

PVA 105, PVA 203, PVA 204, PVA 205 and PVA 405 (from Kuraray Co., Ltd.);

Gosenol NL-05, Gosenol GL-03, Gosenol AL-02 and Goseran (from the Nippon Synthetic Chemical Industry Co., Ltd.);

Denka Poval K-02 and Denka Poval B-03 (from Denki Kagaku Kogyo K.K.)

Illustrative poly(vinyl alcohol) compounds that are modified with strong acids include those which are modified by copolymerization (≦10%) with arylsulfonic acid or vinylsulfonic acid. Illustrative poly(vinyl alcohol) compounds that are modified with weak acids include those which are modified by a carboxyl group or by copolymerization (≦10%) with acrylic acid or methacrylic acid. Illustrative partially acetalized poly(vinyl alcohol) compounds include polyvinyl formal and polyvinyl butyral (degree of acetalization ≦15%, preferably ≦12%).

These modified poly(vinyl alcohol) compounds are also available as commercial products. Strong acid modified poly(vinyl alcohol): Goseran (from The Nippon Synthetic Chemical Industry Co., Ltd.) Weak acid modified poly(vinyl alcohol): KL-506 (from Kuraray Co., Ltd.

The gelatin used in the present invention is typically lime treated gelatin. Acid treated gelatin may also be used. The product of gelatin hydrolysis or enzymolysis may be used as required. Illustrative gelatin derivatives are those which are obtained by reacting gelatin with various compounds such as acid halides, acid anhydrides, isocyanates, bromoacetic acid, alkanesultones, vinylsulfonamides, maleinimide compounds, polyalkylene oxides and epoxy compounds. Specific examples of these compounds are listed in U.S. Pat. Nos. 2,614,928, 3,132,945, 3,186,846, 3,312,553; British Pat. Nos. 861,414, 1,033,189, 1,005,784; and Japanese Patent Publication No. 6845/1967.

Gelatin graft polymers are also usable and they can be prepared by grafting homo- or copolymers of the following vinyl monomers to gelatin: acrylic acid, methacrylic acid, their derivatives such as esters and amides, acrylonitrile and styrene. Preferred grafts are polymers having some miscibility with gelatin, such as polymers of acrylic acid, methacrylic acid, acrylamide, methacrylamide and hydroxyalkyl methacrylate. Illustrative gelatin graft polymers are listed in U.S. Pat. Nos. 2,763,625, 2,831,767 and 2,956,884.

The binder used in the present invention preferably contains 10–90 wt % of gelatin to the binder, with the range of 20–60 wt % being particularly preferred. The binder preferably contains 5 to 90 wt % of the poly(vinyl alcohol) as defined above to the binder, and the range of 10–80 wt % to the binder is particularly preferred. The relative content of the gelatin derivative in the binder ranges from 0 to 100 wt %, preferably from 0 to 50 wt %.

The binder used in the present invention may contain a polymeric material other than the gelatin (or gelatin derivative) and the poly(vinyl alcohol) having the viscosity average polymerization degree of not more than 700. A preferred combination consists of gelatin, poly(vinyl alcohol) having a viscosity average polymerization degree of not more than 500, and one or more of other polymeric materials. Examples of such other polymeric materials include polyvinyl pyrrolidone, polyacrylamide, polymethacrylamide, polyacrylic acid, polymethacrylic acid, polyvinyl butyral, polyethylene glycol, polyethylene glycol ester, proteins (e.g. cellulosic derivatives), and natural products such as polysaccharides (e.g. starch and gum arabic). These polymeric materials are incorporated in amounts ranging from 0 to 85 wt %, preferably from 0 to 70 wt %, to the binder.

The poly(vinyl alcohol) according to the present invention and the additional polymeric material shown above may be cross-linked polymers, but it is preferred that they be cross-linked after the thermally developable, light-sensitive layer containing them in the binder is applied to a support. The cross-linking may take place while the light-sensitive layer spread to the support is left to stand.

The binder according to the present invention is generally used in an amount ranging from 0.005 to 100 g, preferably 0.01 to 40 g, per square meter of the support.

The type of the reducing agent as component (c) of the thermally developable, light-sensitive material of the present invention depends on whether said material is processed by black-and-white photography or color photography, or upon which color processing technique is used. Typical reducing agents are defined and listed in C. E. K. Mees and T. H. James, "The Theory of the Photographic Process", 3rd ed., The Macmillan Book Company, and suitable compounds may be selected depending on the specific need.

The following compounds are used advantageously as reducing agents for incorporation in black-and-white, light-sensitive materials: phenols (e.g. p-phenylphenol, p-methoxyphenol, 2,6-di-tert-butyl-p-cresol and N-methyl-p-aminophenol); sulfonamide phenols (e.g. 4-benzenesulfonamide phenol, 2-benzenesulfonamide phenol, 2,6-dichloro-4-benzenesulfonamide phenol and 2,6-dibromo-4-(p-toluenesulfonamido)phenol); polyhydroxybenzenes (e.g. hydroquinone, tertbutylhydroquinone, 2,6-dimethylhydroquinone, chlorohydroquinone, carboxyhydroquinone, catechol, and 3-carboxycatechol); naphthols (e.g. α-naphthol, β-naphthol, 4-aminonaphthol and 4-methoxynaphthol); hydroxybinaphthyls and methylenebisnaphthols (e.g. 1,1'-dihydroxy-2,2'-binaphthyl, 6,6'-dibromo-2,2'-dihydroxy-1,1-binaphthyl, 6,6'-dinitro-2,2-dihydroxy-1,1-binaphthyl, 4,4'-dimethoxy-1,1'-dihydroxy-2,2'-binaphthyl and bis(2-hydroxy-1-naphthyl)methane); methylenebisphenols (e.g. 1,1-bis(2-hydroxy-3,5-dimethylphenyl)-3,5,5-trimethylhexane, 1,1-bis(2-hydroxy-3-tert-butyl-5-methylphenyl)methane, 1,1-bis(2-hydroxy-3,5-di-tert-butylphenyl)methane, 2,6-methylenebis(2-hydroxy-3-tert-butyl-5-methylphenyl)-4-methylphenol, αphenyl-α,α-bis(2-hydroxy-3,5-di-tert-butylphenyl)methane, α-phenyl-α,α-bis(2-hydroxy-3-tert-butyl-5-methylphenyl)methane, 1,1-bis(2-hydroxy-3,5-dimethylphenyl)2-methylpropane, 1,1,5,5-tetraquis(2-hydroxy-3,5-dimethylphenyl)2,4-ethylpentane, 2,2-bis(4-hydroxy-3,5-dimethylphenyl)propane, 2,2-bis(4-hydroxy-3-methyl-5-tert-butylphenyl)propane, 2,2-bis(4-hydroxy-3,5-di-tert-butylphenyl)propane); ascorbic acids, 3-pyrazolidones, pyrazolines, pyrazolones, hydrazones and paraphenylenediamines.

When the thermally developable, light-sensitive material of the present invention is to be processed by color photography, the type of the reducing agent used depends on the kind of color providing material. If the color providing material used is of such a kind that an image forming dye is released only by redox reaction, for example, if the color providing material is one of the leuco dyes shown in U.S. Pat. Nos. 3,985,565 and 4,722,617 and RD No. 12533, or if a dye itself is used as a reducing agent or its precursor as shown in RD Nos. 15126 and 17706 or in Japanese Patent Application No. 164903/1982 filed by the applicant of subject application, such color providing material may be used as the reducing agent either independently or in combination with other reducing agents or one of the reducing agents listed above. In a process of the type using the dye silver salts shown in British Pat. Nos. 1,590,956 and 1,590,957, the reducing agents listed above may be used without any modification. If the color providing material is a "dye releaser", such as shown in U.S. Pat. No. 4463079 and Japanese Patent Application (OPI) No. 186745/1982, the color providing material may be used either independently or in combination with a cross-oxidizable reducing agent selected from among the reducing compounds shown above.

The color providing material incorporated in the thermally developable, color light-sensitive material may be of the type that releases or forms a dye by the oxidative coupling with a reducing agent; specifically, the color providing material may be one of the compounds shown in Japanese Patent Application (OPI) Nos. 186744/1982, 207250/1982, 40551/1983, 79247/1983, Japanese Patent Application No. 129516/1983, U.S. Pat. Nos. 3,531,286, 3,764,328, and Japanese Patent Application (OPI) No. 27132/1981, and at the same time, said material may be a phenolic or naphtholic compound having active methylene or active methine, or pyrazolone, pyrazolotriazole, indazole, pyrazolobenzimidazole, pyrazoline, or a derivative thereof such as acylacetamide, which also has active methylene or methine. In the case shown above, p-phenylenediamine or p-aminophenolic developing agent, phosphoroamidophenolic or sulfonamidophenolic developing agent, or a hydrazone type color developing agent may advantageously be used as the reducing agent, and specific examples are given in U.S. Pat. Nos. 3,531,286, 3,761,270, 3,764,328, RD Nos. 12146, 15108 and 15127, as well as Japanese Patent Application (OPI) Nos. 27132/1981 and 146133/1981. As a result of the oxidative coupling with these reducing agents, the color developing material releases or forms a diffusible dye. Other advantageous reducing agents are color developing agent precursors of the type shown in U.S. Pat. Nos. 3,342,599, 3,719,492, Japanese Patent Application (OPI) Nos. 135628/1978 and 79035/1979.

Typical examples of the developing agent that can be used as the reducing agent in the present invention include p-phenylenediamines such as N,N-diethyl-p-phenylenediamine, 4-amino-3-methyl-N,N-diethylaniline, 4-amino-3-methyl-N-ethyl-N-methanesulfonamidoethylaniline, 4-amino-N-ethyl-N-hydroxyethylaniline, 4-amino-3-methyl-N-ethyl-N-β-methoxyethylaniline, and 4-amino-N-ethyl-N-β-sulfopropylaniline; p-dialkylaminophenylsulfamic acid sodium salts such as sodium p-(N,N-diethylamino)phenylsulfamate, sodium 4-(N,N-diethylamino)-2-methyl-phenylsulfamate, sodium 4-(N,N-di-propylamino)2-methylphenylsulfamate, sodium 4-(N,N-diethylamino-2-chlorophenylsulfamate, sodium 4-(N,N-dimethylamino)-2-methoxyphenylsulfamate and sodium 4-morpholinophenylsulfamate; sulfonamidoanilines such as 4-methanesulfonamido-N,N-diethylaniline, 4-benzenesulfonamido-N,N-diethylaniline, 4-toluenesulfonamido-3-methyl-N,N-diethylaniline, 4-methanesulfonamido-3-chloro-N,N-diethylaniline, 4-methanesulfonamido-3-methoxy-N,N-diethylaniline, 4-methanesulfonamido-3-methyl-N-methyl-N-carboxyethylaniline, 4-methanesulfonamido-3-methyl-N-ethyl-N-sulfopropylaniline, and 4-(m-sulfoaminophenyl)-sulfonamido-3-methyl-N,N-diethylaniline.

These reducing agents may be used either alone or in combination. The amount of the reducing agent used depends on the purpose and the type of the light-sensitive material used, the type of the organic silver salt used, the type of the light-sensitive silver halide, and the type of other additives that may be used. Usually, the amount of the reducing agent ranges from 0.05 to 10 mols per mol of the organic silver salt, and the range of 0.1 to 3 mols is preferred.

While various color providing materials may be used when the thermally developable, light-sensitive material of the present invention is to be processed by color photography, particularly preferred are those which release or form a dye by oxidative coupling, as shown in U.S. Pat. No. 3,531,286, Japanese Patent Application (OPI) Nos. 186744/1982, 207250/1982, 40551/1983 and 79247/1983, and Japanese Patent Application Nos. 229671/1982 and 33364/1983, both filed by the applicant of subject application.

Particularly preferred color providing materials for use in the present invention are compounds that have within the molecule a water-soluble group such as sulfo or salt thereof, carboxy or salt thereof, or sulfamoyl or salt thereof and which release or form a diffusible dye by heat development. Preferred diffusible dyes are hydrophobic dyes which do not have a polar group such as sulfo, carboxyl or sulfamoyl. Therefore, it is advantageous for the purposes of the present invention that the color providing material is selected from among the compounds of formula (1) which release a hydrophobic dye by heat development:

A-B-C (1)

wherein A is a coupler residual group; B is either a simple bonding group or a divalent bonding group; C is a hydrophobic dye or dye precursor residual group. The coupler residual group represented by A has a hydrophilic group such as sulfo or salt thereof, carboxyl or salt thereof, or sulfamoyl or salt thereof.

Particularly preferred color providing materials for use in the present invention are those which have active methylene, active methine, phenol or naphthol residual group as A in formula (1). Such preferred compounds are represented by the following formulas (2) to (8):

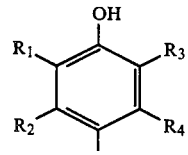
(2)

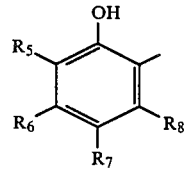
(3)

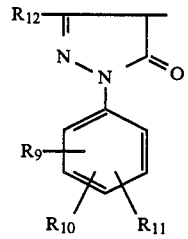
(4)

$R_{13}COCHCOR_{14}$ (5)

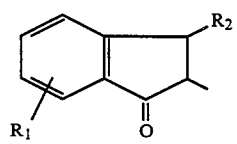
(6)

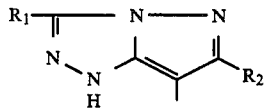
(7)

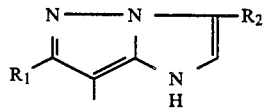
(8)

wherein $R_1$ to $R_8$ are each a hydrogen atom, a halogen atom (preferably chlorine, bromine or iodine), a sulfo group, a carboxyl group, a sulfamoyl group, an alkyl group (preferably an alkyl group having 1 to 24 carbon atoms, such as methyl, ethyl, butyl, t-octyl, n-dodecyl, n-pentadecyl or cyclohexyl, or an aryl-substituted alkyl group such as benzyl or phenetyl), a substituted or unsubstituted aryl group (e.g. phenyl, naphthyl, tolyl or mesityl), an acyl group (e.g. acetyl, tetradecanoyl, pivaloyl, or substituted or unsubstituted benzoyl), an alkyloxycarbonyl group (e.g. methoxycarbonyl or benzyloxycarbonyl), an aryloxycarbonyl group (e.g. phenoxycarbonyl, p-tolyloxycarbonyl or α-naphthoxycarbonyl), an alkylsulfonyl group (e.g. methylsulfonyl), an arylsulfonyl group (e.g. phenylsulfonyl), a carbamoyl group (e.g. substituted or unsubstituted alkyl carbamoyl such as methyl carbamoyl, butyl carbamoyl, tetradecyl carbamoyl, or N-methyl-N-dodecyl carbamoyl, an optionally substituted phenoxyalkyl carbamoyl group such as 2,4-di-t-amylphenoxybutyl-carbamoyl, or substituted or unsubstituted phenyl carbamoyl such as 2-dodecyloxyphenyl carbamoyl), a substituted or unsubstituted acylamino group (e.g. n-butylamino, laurylamido, optionally substituted β-phenoxyethylamido, phenoxyacetamido, substituted or unsubstituted benzamido, methanesulfonamidoethylamido, or β-methoxyethylamido), an alkoxy group preferably an alkoxy group having 1 to 18 carbon atoms, such as methoxy, ethoxy, or octadecyloxy), a sulfamoyl group (e.g. methylsulfamoyl, n-dodecylsulfamoyl, substituted or unsubstituted phenylsulfamoyl such as dodecylphenylsulfamoyl), a sulfonylamino group (e.g. methylsulfonylamino or tolylsulfonylamino), or a hydroxyl group;

$R_1$ and $R_2$, or $R_7$ and $R_8$, when taken together, may form a saturated or unsaturated 5- or 6-membered ring;

$R_9$, $R_{10}$ and $R_{11}$ are each a hydrogen atom, a halogen atom (preferably chlorine, bromine or iodine), an alkyl group (preferably an alkyl group having 1 to 2 carbon atoms, such as methyl or ethyl), an alkoxy group (preferably an alkoxy group having 1 to 2 carbon atoms such as methoxy or ethoxy), a substituted or unsubstituted alkylamido group (e.g. laurylamido), an optionally substituted phenoxyalkylamido group (e.g. alkyl-substituted phenoxyacetamido), or a substituted or unsubstituted arylamido group;

$R_{12}$ is an alkyl group (preferably an alkyl group having 1 to 24 carbon atoms, such as methyl, butyl or heptadecyl), an alkoxy group (preferably an alkoxy group having 1 to 18 carbon atoms, such as methoxy, ethoxy or octadecyloxy), an arylamino group (e.g. anilino which may be substituted by halogen, alkyl, amido or imido), a substituted or unsubstituted alkylamido group (e.g. laurylamido, or an optionally substituted phenoxyacetamido or phenoxybutaneamido), a substituted or unsubstituted arylamido group (e.g. benzamido, which may be substituted by halogen, alkyl or alkoxyamido);

$R_{13}$ is an alkyl group (preferably an alkyl group having 1 to 8 carbon atoms), or a substituted or unsubstituted aryl group (e.g. phenyl, tolyl or methoxyphenyl); and $R_{14}$ is an arylamino group (e.g. anilino, which may be substituted by halogen, alkyl, alkoxy, alkylamido, arylamido or imido).

In order to reduce their heat diffusibility, the compounds represented by formulas (2) to (8) preferably have at least one of sulfo, carboxyl and sulfamoyl groups within the molecule, and these water-soluble groups may be present as a substituent in $R_1$ to $R_{14}$. More preferably, these compounds contain in the molecule at least one alkyl group having not less than 8, preferably not less than 12, carbon atoms, or at least one aryl group having an alkyl group of not less than 4 carbon atoms.

As already mentioned, B in formula (1) may be a simple bonding group (ie., the case where the coupler residual group is directly bonded to the heat-transferable dye residue or the residual group of a heat-transferable dye precursor), or a divalent bonding group. Examples of the divalent bonding group are—O—, —S—, —NHCO—, $$-\underset{\underset{O}{\|}}{C}-,\ -O-\underset{\underset{O}{\|}}{C}-O-,\ -\underset{\underset{O}{\|}}{C}-NH-,$$

$-NHSO_2-$, —N=N— and $-OSO_2-$. Particularly preferred are those groups which do not leave any highly hydrophilic group within the dye released, and examples of such preferred groups —O—, —S—, $$-O-\underset{\underset{O}{\|}}{C}-O-,\ -O\underset{\underset{O}{\|}}{C}-NH-$$

and —N=N—.

Preferred examples of the hydrophobic dye residual group represented by C in formula (1) include an azo dye residue, anthraquinone dye residue, azomethine dye residue, indoaniline dye residue or nitrodiphenylamine dye residue. A suitable residue may be selected in view of the desired color or dye fastness.

Another useful type of the color providing material that can be used in the present invention is selected from among the compounds of the following formula (9):

$$A'\text{-}B' \qquad (9)$$

wherein A' is a hydrophobic coupler residue which does not include in its category a water-soluble group such as sulfo, carboxyl or sulfamoyl; B' is a group that can be eliminated from the coupler by the coupling reaction and which is selected from among sulfo, carboxyl, sulfamoyl or any other groups that contain one of these groups. A particularly preferred compound of formula (9) is a coupler which reacts with the oxidized product of a color developing agent, as shown in Japanese Patent Application No. 229647/1982 filed by the applicant and forms a sublining or evaporative dye. This coupler forms a hydrophobic and heat-transferable dye through the coupling reaction with the oxidized body of a color developing agent that is formed as a result of heat development, and preferred examples of this coupler residue are indicated below by formulas (10) to (14):

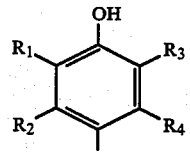

(10)

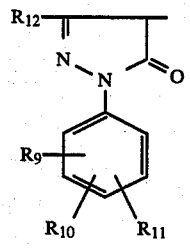

(11)

$R_{13}COCHCOR_{14}$ (12)

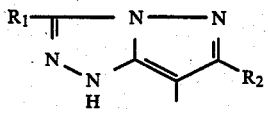

(13)

-continued

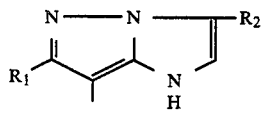

(14)

wherein $R_1$ to $R_4$ are each a hydrogen atom, a halogen atom (preferably chlorine, bromine or iodine), an alkyl group (preferably an alkyl group having 1 to 24 carbon atoms, such as methyl, ethyl, butyl, t-octyl, n-dodecyl, n-pentadecyl or cyclohexyl, oran aryl-, say, phenyl-substituted alkyl group such as benzyl or phenetyl), a substituted or unsubstituted aryl group (e.g. phenyl, naphthyl, tolyl or methyl), an acyl group (e.g. acetyl, tetradecanoyl, pivaloyl, or substituted or unsubstituted benzoyl), an alkyloxycarbonyl group (e.g. methoxycarbonyl or benzyloxycarbonyl), an aryloxycarbonyl group (e.g. phenoxycarbonyl, p-tolyloxycarbonyl or α-naphthoxycarbonyl), an alkylsulfonyl group (e.g. methylsulfonyl), an arylsulfonyl group (e.g. phenylsulfonyl), a carbamoyl group (e.g. substituted or unsubstituted alkyl carbamoyl such as methyl carbamoyl, butyl carbamoyl, tetradecyl carbamoyl or N-methyl-N-dodecyl carbamoyl, an optionally substituted phenoxyalkyl carbamoyl group such as 2,4-di-t-amylphenoxybutyl carbamoyl, or substituted or unsubstituted phenyl carbamoyl such as 2-dodecyloxyphenyl carbamoyl), a substituted or unsubstituted acylamino group (e.g. n-butylamido, laurylamido, optionally substituted β-phenoxyethylamido, phenoxyacetamido, substituted or unsubstituted benzamido, methanesulfonamidoethylamido, or β-methoxyethylamido), an alkoxy group (preferably an alkoxy group having 1 to 18 carbon atoms, such as methoxy, ethoxy or octadecyloxy), a sulfamoyl group (e.g. methylsulfamoyl, n-dodecylsulfamoyl, substituted or unsubstituted phenylsulfamoyl, such as dodecylphenylsulfamoyl), a sulfonylamino group (e.g. methylsulfonylamino or tolylsulfonylamino), or a hydroxyl group; provided that $R_1$ and $R_2$, or $R_7$ and $R_8$, when taken together, may form a saturated or unsaturated 5- or 6-membered ring;

$R_9$, $R_{10}$ and $R_{11}$ are each a hydrogen atom, a halogen atom (preferably chlorine, bromine or iodine), an alkyl group (preferably an alkyl group having 1 to 2 carbon atoms, such as methyl or ethyl), an alkoxy group (preferably an alkoxy group having 1 to 2 carbon atoms such as methoxy or ethoxy), a substituted or unsubstituted alkylamido group (e.g. laurylamido), an optionally substituted phenoxyalkylamido group (e.g. alkyl-substituted phenoxyacetamido), or a substituted or unsubstituted arylamido group;

$R_{12}$ is an alkyl group (preferably an alkyl group having 1 to 24 carbon atoms, such as methyl, butyl or heptadecyl), an alkoxy group (preferably an alkoxy group having 1 to 18 carbon atoms, such as methoxy, ethoxy or octadecyloxy), an arylamino group (e.g. anilino which may be substituted by halogen, alkyl, amido or imido), a substituted or unsubstituted alkylamido group (e.g. laurylamido, or an optionally substituted phenoxyacetamido or phenoxybutaneamido), a substituted or unsubstituted arylamido group (e.g. benzamido, which may be substituted by halogen, alkyl or alkoxyamido);

$R_{13}$ is an alkyl group (preferably an alkyl group having 1 to 8 carbon atoms), or a substituted or unsubstituted aryl group (e.g. phenyl, tolyl or methoxyphenyl); and $R_{14}$ is an arylamino group (e.g. anilino, which may be substituted by halogen, alkyl, alkoxy, alkylamido, arylamido or imido).

The symbol B′ in formula (9) represents a sulfo group, a carboxyl group, a sulfamoyl group, or a group represented by -J-Y (wherein J is a divalent bonding group, and Y is a substituted or unsubstituted alkyl or aryl group). Specific examples of the divalent bonding group represented by J include the following: —O—, —S—, $$-\underset{\underset{O}{\|}}{OCO}-,\ -\underset{\underset{O}{\|}}{OC}-NH-,\ -\underset{\underset{O}{\|}}{CO}-,$$

—N=N—, —NHCO—, —NHSO—, and —O—$SO_2$—. Examples of the alkyl or aryl group represented by Y are sulfo, carboxyl and sulfamoyl, and a substituted alkyl or alkyl group is preferred. Particularly preferred are an alkyl group which is substituted by an optionally substituted alkylcarbamoyl group or arylcarbamoyl group, an alkyl group which is substituted by a carboalkoxy or carboaryloxy group, an alkyl group which is substituted by a halogen atom, an aryl group which is substituted by an optionally substituted alkylamido, alkylsulfonamido, arylamido, or arylsulfonamido group, an aryl group which is substituted by an optionally substituted alkylcarbamoyl, alkylsulfamoyl, arylcarbamoyl, arylsulfamoyl group, or a substituted or unsubstituted alkyl group having 1 to 22 carbon atoms, an aryl group which is substituted by an optionally substituted alkyl group having 1 to 22 carbon atoms, and an aryl group which is substituted by a halogen atom, a hydroxyl, sulfo, carboxyl or sulfamoyl group.

The substituents at active site shown above must contain a sulfo, carboxyl, sulfamoyl or the like that immobilizes the molecule of the coupler in a layer against heat. Preferably, the molecule of the coupler further contains an alkyl group having not less than 8 carbon atoms or an aryl group having an alkyl group of not less than 4 carbon atoms. The term "molecule of the coupler" means either the coupler residue represented by A′ in formula (1) or the substituent at active site represented by B′. If a dye which sublimes is desired, the alkyl group or alkyl-substituted aryl group defined above is preferably present within the substituent at active site. Transfer by a melt former is satisfactorily possible even if such alkyl or substituted aryl group is present within the coupler residue. In whichever case, the hydrophilic substituent at active site is eliminated and a hydrophobic dye formed as a result of oxidative coupling with the color developing agent.

Illustrative color providing materials (CPM) that can be used with advantage in the present invention are listed below, to which the scope of the invention is by no means limited:

1
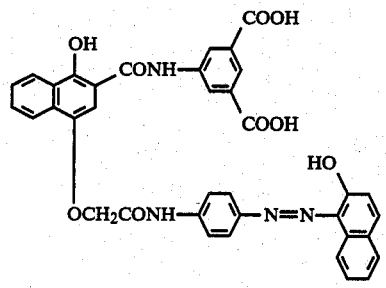
2
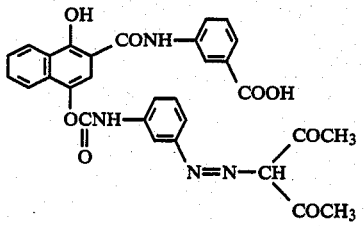
3
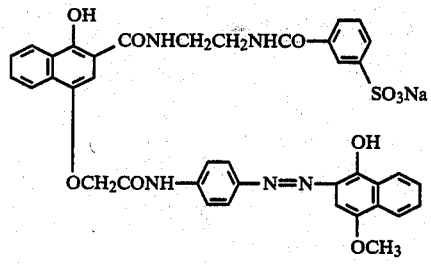
4
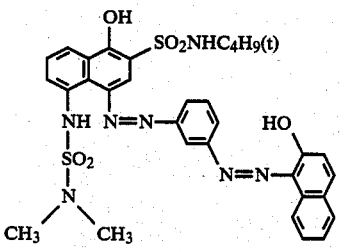
5
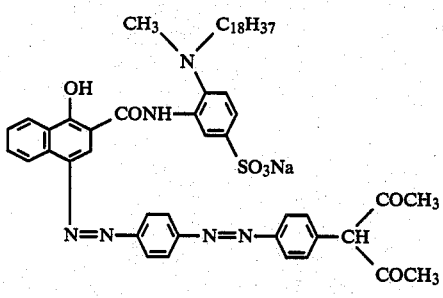
6
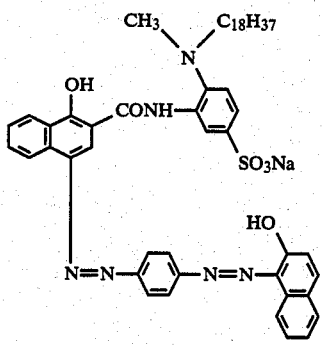
-continued
7
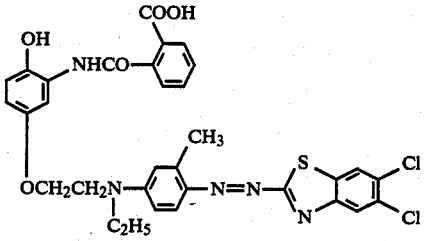
8
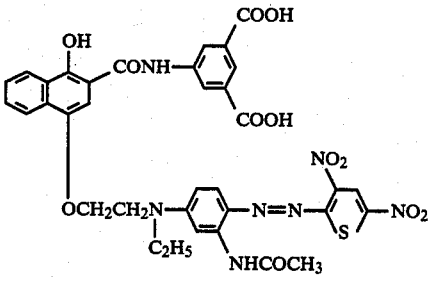
9
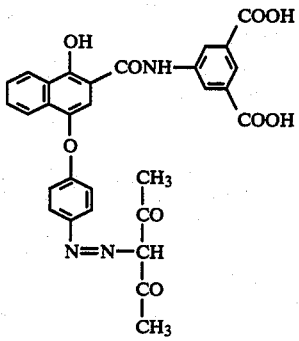
10
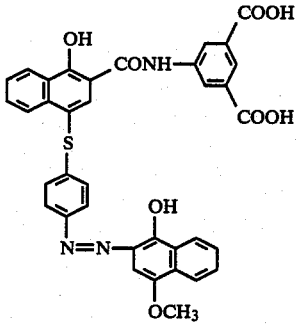
11
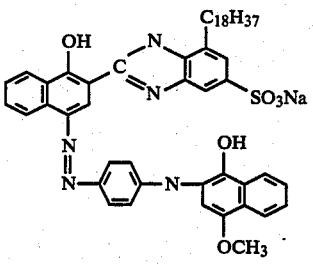
12
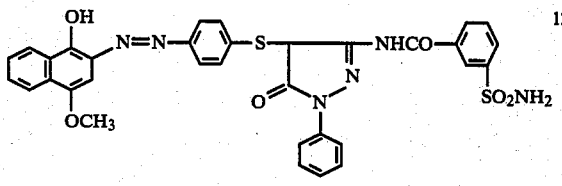

-continued
13
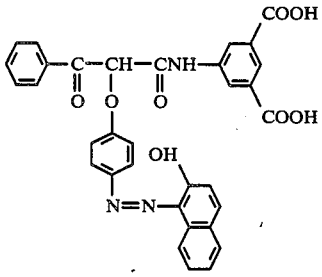
14
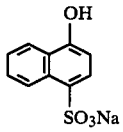
15
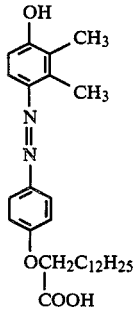
16
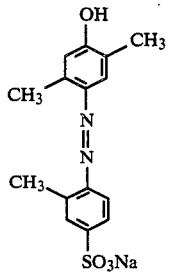
17
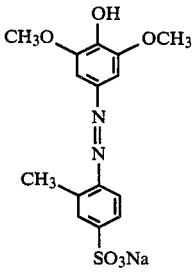
18
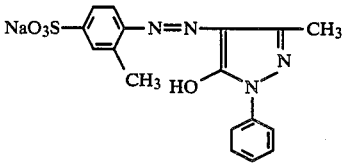
19
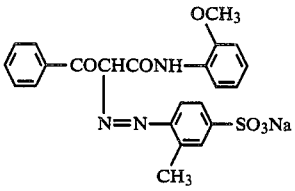
-continued
20
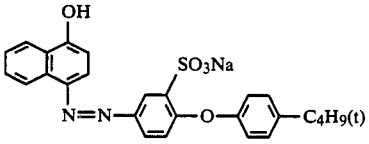
21
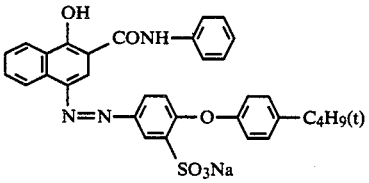
22
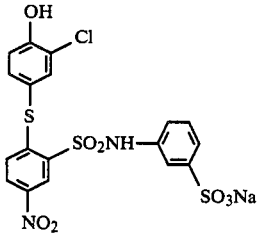
23
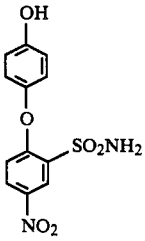
24
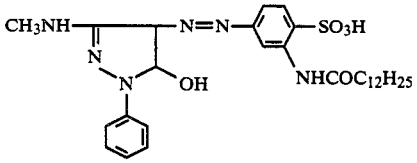
25
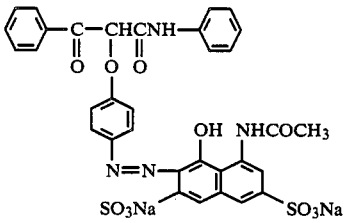
26
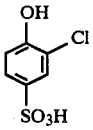
27
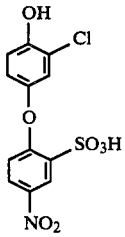

-continued
28
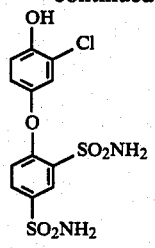
29
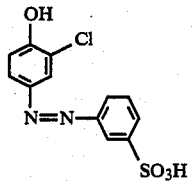
30
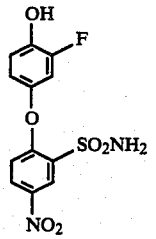
31
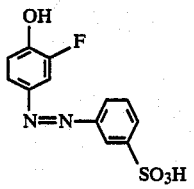
32
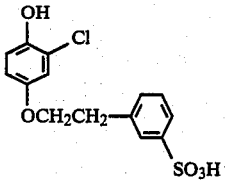
33
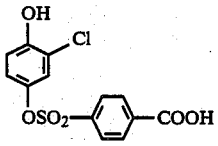
34
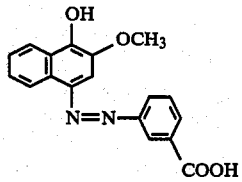
35
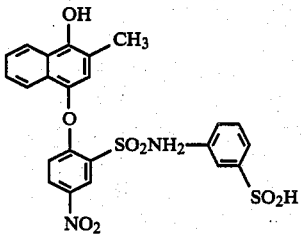
-continued
36
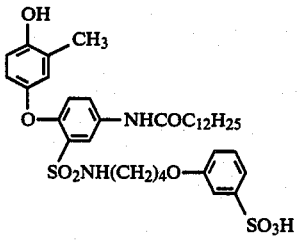
37
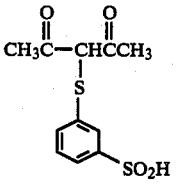
38
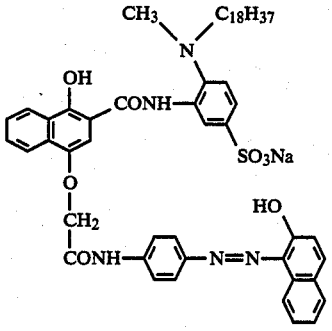
39
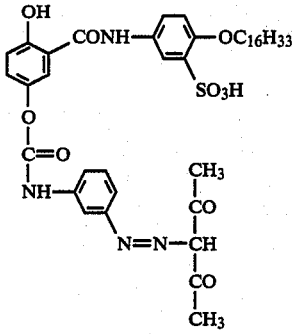
40
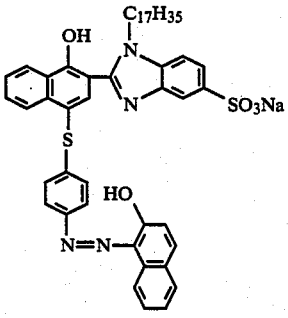

-continued
41
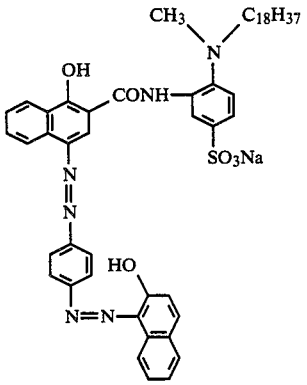
42
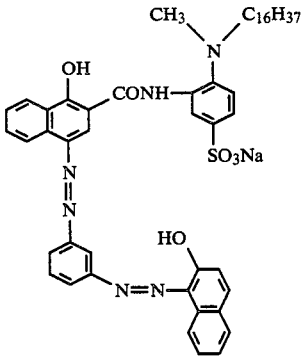
43
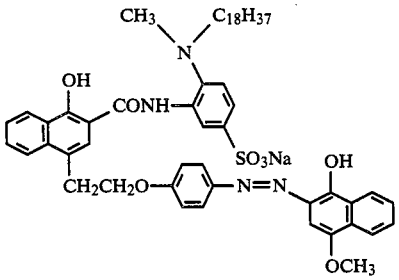
44
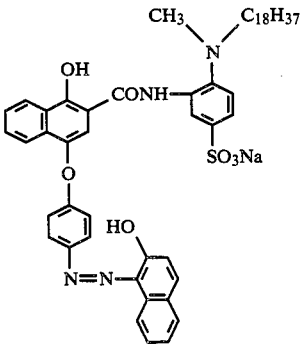
-continued
45
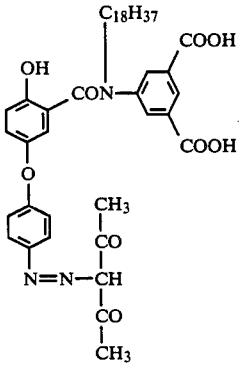
46
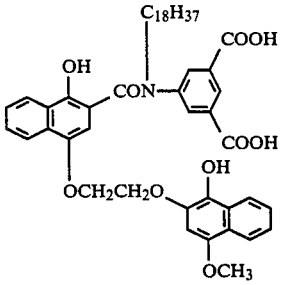
47
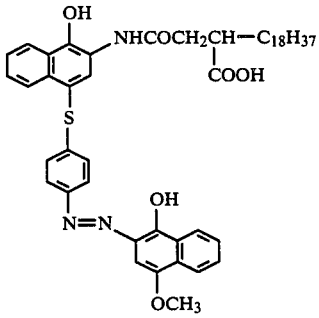
48
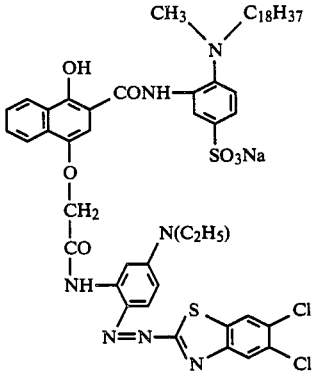
49
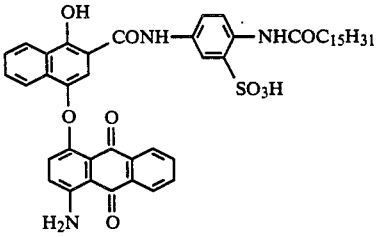

-continued
50
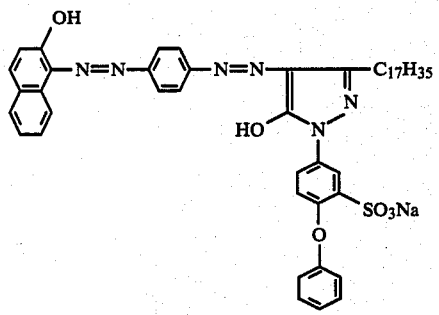
51
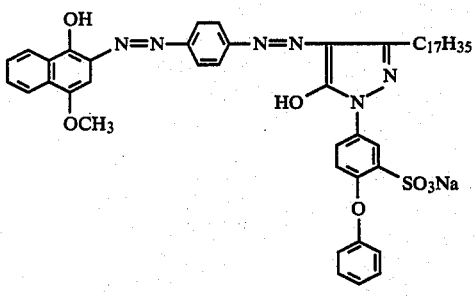
52
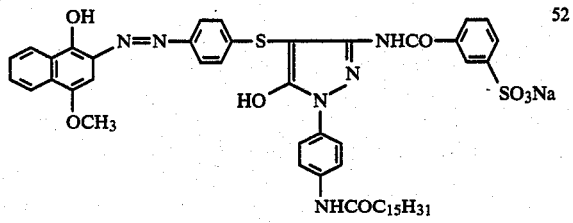
53
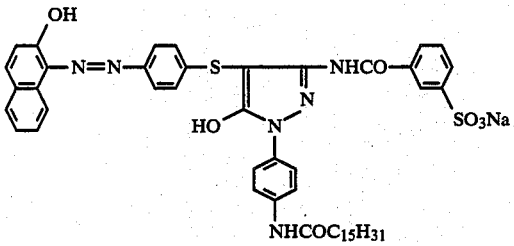
54
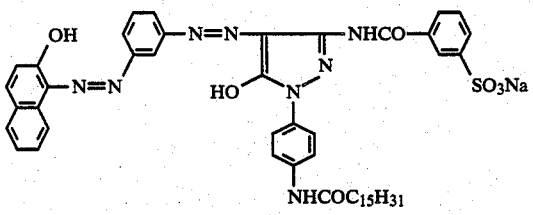
55
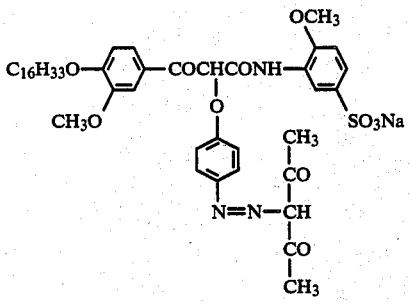
-continued
56
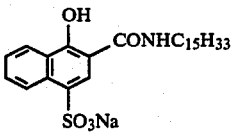
57
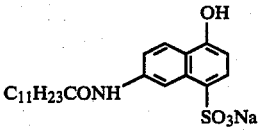
58
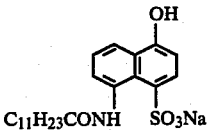
59
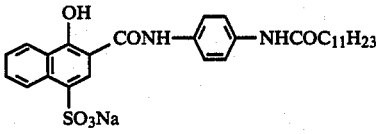
60
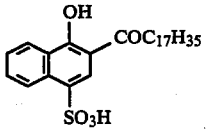
61
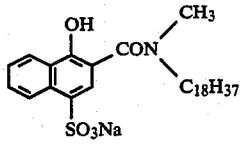
62
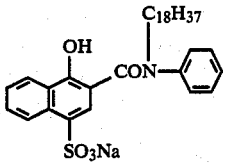
63
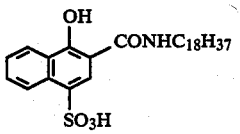
64
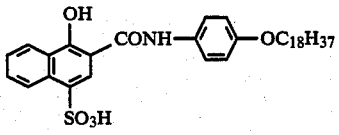
65
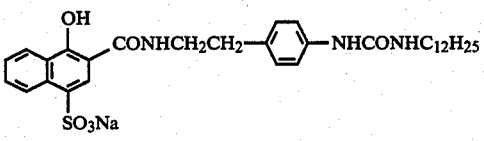

-continued
66
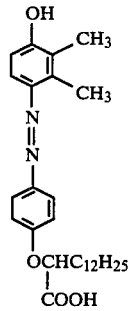
67
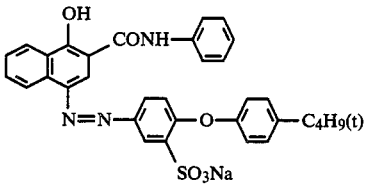
68
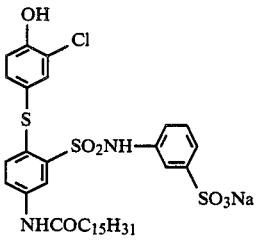
69
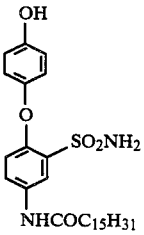
70
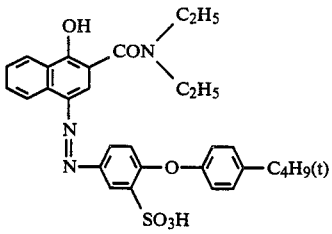
71
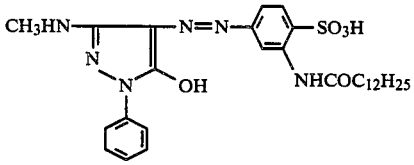
72
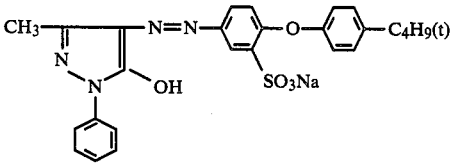
-continued
73
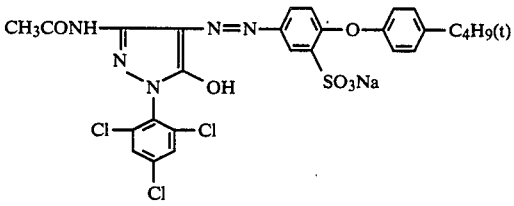
74
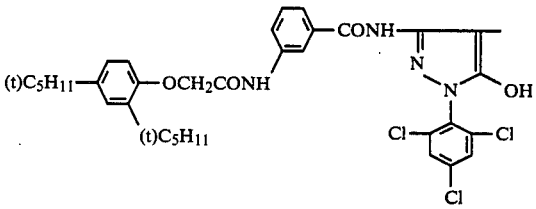
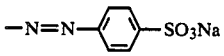
75
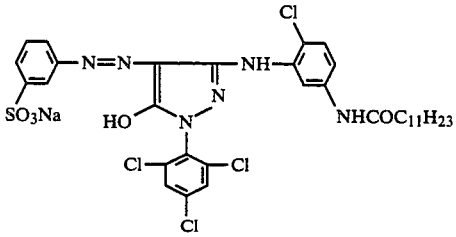
76
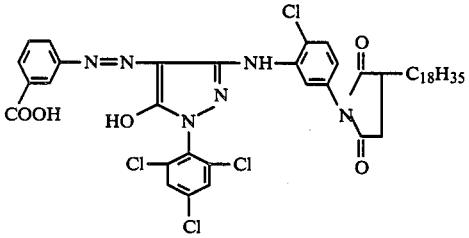
77
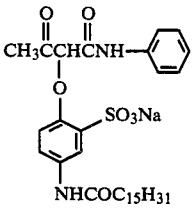
78
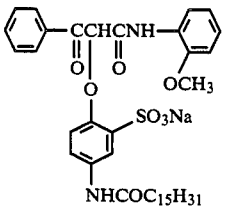

-continued

79

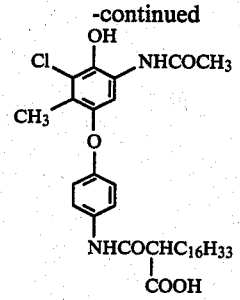

80

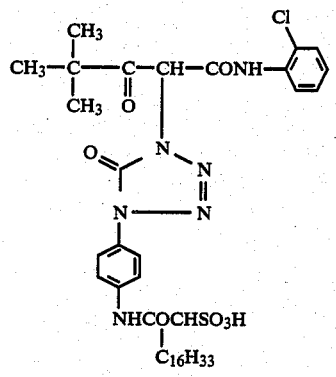

The color providing materials that are used with advantage in the present invention may be incorporated in the thermally developable, color light-sensitive layer either after dissolution or by ball milling treatment or by protected dispersion or Fischer dispersion. The color providing materials are used in amounts ranging from about 0.01 to 10 mols, preferably 0.1 to 2.0 mols, per mol of the organic silver salt.

The color providing materials used in the present invention may be synthesized either by the method shown in Japanese Patent Application (OPI) No. 186744/1982 or by the method described in Japanese Patent Application No. 229671/1982 filed by the applicant of subject application.

Examples of the light-sensitive silver halide that is used as component a) in the material of the present invention include silver chloride, silver bromide, silver iodide, silver chlorobromide, silver chloroiodide, silver iodobromide, silver chloroiodobromide and mixtures thereof. These light-sensitive silver halides may be prepared by the single-jet method, double-jet method or any other methods known in the photographic art. For the purposes of the present invention, the light-sensitive silver halide emulsion prepared by the method used to prepare conventional silver halide-gelatin emulsions provides preferred results.

The light-sensitive silver halide emulsion prepared as above may be chemically sensitized by any of the methods known in the photographic art. Possible methods of sensitization are gold sensitization, sulfur sensitization, gold-sulfur sensitization and reduction sensitization.

The silver halide in the light-sensitive emulsion may be made of either coarse or fine grains. A preferred particle size is in the range of from about 0.001 to about 1.5 μm, and the range of about 0.01 to about 0.5 μm is more preferred. In the present invention, the silver halide grains having either a narrower or wider grain size distribution than said range may be used.

The light-sensitive silver halide emulsion thus prepared is incorporated most advantageously in the thermally developable, light-sensitive layer which is one of the layers that constitute the light-sensitive material of the present invention.

According to another method for preparing the light-sensitive silver halide, a light-sensitive silver salt forming component is provided in combination with an organic silver salt and a desired light-sensitive silver halide is formed in part of the organic silver salt. Inorganic halides may be used as the light-sensitive silver salt forming component in this method and they include halides of the formula MXn (wherein M is H, $NH_4$ or a metal atom; X is Cl, Br or I; n is 1 when M is H or $NH_4$ and represents the valency of a metal atom represented by M; examples of the metal atom include lithium, sodium, potassium, rubidium, cesium, copper, gold, beryllium, magnesium, calcium, strontium, barium, zinc, cadmium, mercury, aluminum, indium, lanthanum, ruthenium, thalium, germanium, tin, lead, antimony, bismuth, chromium, molybdenum, tungsten, manganese, rhenium, iron, cobalt, nickel, rhodium, palladium, osmium, iridium, platinum and cerium); halogen-containing metal complexes (e.g. $K_2PtCl_5$, $K_2PtBr_6$, $HAuCl_4$, $(NH_4)_2IrCl_6$, $(NH_4)_2RuCl_6$, $(NH_4)_3RuCl_6$, $(NH_4)_3RhCl_6$, $(NH_4)_3RhBr_6$); onium halides (e.g. quaternary ammonium halides such as tetramethylammonium bromide, trimethylphenylammonium bromide, cetylethyldimethylammonium bromide, 3-methylthiazolium bromide and trimethylbenzylammonium bromide, quaternary phosphonium halides such as tetraethylphosphonium bromide, and tertiary sulfonium halides such as benzylethylmethyl bromide and 1-ethylthiazolium bromide); hydrocarbon halides (e.g. iodoform, bromoform, carbon tetrabromide and 2-bromo-2-methylpropane); N-halogen compounds (e.g. N-chlorosuccinimide, N-bromosuccinimide, N-bromophthalimide, N-bromoacetamide, N-iodosuccinimide, N-bromophthalazinone, N-chlorophthalazinone, N-bromoacetanilide, N,N-dibromobenzenesulfonamide, N-bromo-N-methylbenzenesulfonamide and 1,3-dibromo-4,4-dimethylhydantoin); and other halogen-containing compounds (e.g. triphenylmethyl chloride, triphenylmethyl bromide, 2-bromobutyric acid and 2-bromoethanol).

The light-sensitive silver-halides and light-sensitive silver salt forming components shown above may be used in various combinations in amounts ranging from about 0.01 to 1.0 mol, preferably 0.01 to 0.3 mol, per mol of the organic silver salt.

When the present invention is applied to a thermally developable, color light-sensitive material, a multi-layer arrangement consisting of layers which are sensitive to blue, green and red lights (i.e., thermally developable blue-sensitive layer, thermally developable green-sensitive layer and thermally developable red-sensitive layer) may be used. In this case, the blue-sensitive silver halide emulsion, green-sensitive silver halide emulsion and red-sensitive silver halide emulsion may be prepared by adding suitable spectral sensitizing dyes to the silver halide emulsion prepared by the method shown above.

Typical spectral sensitizing dyes that may be used in the present invention include cyanine, merocyanine, complex (3- or 4-nuclear) cyanine, holopolar cyanine, styryl, hemicyanine and oxonol dyes. Cyanine dyes having a basic nucleus are preferred and they include thiazoline, oxazoline, pyrroline, pyridine, oxazole, thiazole, senenazole and imidazole. The basic nucleus may oontain an alkyl group, an alkylene group, a hydroxyalkyl group, a sulfoalkyl group, a carboxyalkyl group, an aminoalkyl group, or an enamine group capable of forming a fused carbon ring or a heterocyclic ring. The nucleus may be symmetric or asymmetric; it may have an alkyl, phenyl, enamine or hetero-ring substituted group in the methine or polymethine chain.

The merocyanine dyes may contain an acidic nucleus in addition to the basic nucleus, and illustrative acidic nuclei are thiohydantoin nucleus, rhodanine nucleus, oxazolizinedione nucleus, thiazolizinedione nucleus, barbituric acid nucleus, thiazolinethione nucleus, malononitrile nucleus, and pyrazolone nucleus. These acidic nuclei may be substituted by an alkyl, alkylene, phenyl, carboxyalkyl, sulfoalkyl, hydroxyalkyl, alkoxyalkyl or alkylamine group, or by a heterocyclic nucleus. The spectral sensitizing dyes mentioned above may be used in combination as required. Ascorbic acid derivatives, azaindene cadmium salts, organic phosphonic acid and other supersensitizing additives that do not absorb visible light and which are shown in U.S. Pat. Nos. 2,993,390 and 2,937,089 may also be used in combination with the spectral sensitizing dyes.

The spectral sensitizing dyes shown above are used in amounts which generally range from about $1\times10^{-4}$ to 1 mol, preferably from $1\times10^{-4}$ to $1\times10^{-1}$ mol, per mol of the silver halide or silver halide forming component.

Examples of the organic silver salt that may be used when the present invention is applied to a thermally developable, color light-sensitive material are given in Japanese Patent Publication Nos. 4924/1968, 26582/1969, 18416/1970, 12700/1970, 22185/1970.

Japanese Patent Application (OPI) Nos. 52626/1974, 31728/1977, 13731/1977, 141222/1977, 36224/1978, 37610/1978, and U.S. Pat. Nos. 3,330,633 and 4,168,980; they include silver salts of aliphatic acids such as silver laurate, silver myristate, silver palmitate, silver stearate, silver arachidonate and silver behenate; silver salts of aromatic carboxylic acids such as silver benzoate and silver phthalate; silver salts having an imino group such as benzotriazole silver, saccharin silver, phthalazinone silver and phthalimide silver; silver salts of compounds having a mercapto or thion group such as 2-mercaptobenzoxazole silver, mercaptoxadiazole silver, mercaptobenzothiazole silver, 2-mercaptobenzimidazole silver and 3-mercapto-phenyl-1,2,4-triazole silver; as well as 4-hydroxy-6-methyl-1,3,3a,7-tetrazaindene silver and 5-methyl-7-hydroxy-1,2,3,4,6-pentazaindene silver. Silver compounds of the type shown in RD Nos. 16966, 16907, British Patent Nos. 1,590,956 and 1,590,957 may also be used. Particularly preferred are silver salts having an imino group such as benzotriazole silver. Illustrative silver salts of benzotriazole include an alkyl-substituted benzotriazole silver such as methyl benzotriazole silver, a halogen-substituted benzotriazole silver such as chlorobenzotriazole silver, an amido-substituted benzotriazole silver such as 5-acetamidobenzotriazole silver, as well as the compounds shown in British Patent Nos. 1,590,956 and 1,590,957 such as N-[6-chloro-4-N-(3,5-dichloro-4-hydroxyphenyl)imino-1-oxo-5-methyl-2,5-cyclohexadien-2-yl]-5-carbamoylbenzotriazole silver salt, 2-benzotriazole-5-ylazo-4-methoxy-1-naphthol silver salt, 1-benzotriazole-5-ylazo-2-naphthol silver salt and N-benzotriazole-5-yl-4-(4-dimethylaminophenylazo)benzamide silver salt.

Also advantageous are the nitrobenzotriazoles of the formula (16) and the benzotriazoles of the formula (17) shown below:

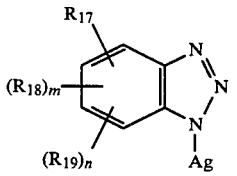

(16)

wherein $R_{17}$ is a nitro group; $R_{18}$ and $R_{19}$ which may be the same or different each represents a halogen atom (e.g. Cl, Br or I), a hydroxy group, a sulfo group or a salt thereof (e.g. sodium salt, potassium salt or ammonium salt), a carboxy group or a salt thereof (e.g. sodium salt, potassium salt or ammonium salt), a nitro group, a cyano group or an optionally substituted carbamoyl, sulfamoyl, alkyl (e.g. methyl, ethyl or propyl), alkoxy (e.g. methoxy or ethoxy), aryl (e.g. phenyl) or amino group; m is 0–2; n is 0 or 1. Illustrative substituents on the carbamoyl group include methyl, ethyl and acetyl; illustrative substituents on the sulfamoyl group include methyl, ethyl and acetyl; illustrative substituents on the alkyl group include carboxy and ethoxy carbonyl; illustrative substituents on the aryl group include sulfo and nitro; illustrative substituents on the alkoxy group include carboxy and ethoxycarbonyl; and illustrative substituents on the amino group include acetyl, methanesulfonyl and hydroxy.

The compounds of formula (16) shown above are silver salts of benzotriazole derivatives having at least one nitro group, and specific examples of such compounds are listed below:

4-nitrobenzotriazole silver, 5-nitrobenzotriazole silver, 5-nitro-6-chlorobenzotriazole silver, 5-nitro-6-methylbenzotriazole silver, 5-nitro-6-methoxybenzotriazole silver, 5-nitro-7-phenylbenzotriazole silver, 4-hydroxy-5-nitrobenzotriazole silver, 4-hydroxy-7-nitrobenzotriazole silver, 4-hydroxy-5,7-dinitrobenzotriazole silver, 4-hydroxy-5-nitro-6-chlorobenzotriazole silver, 4-hydroxy-5-nitro-6-methylbenzotriazole silver, 4-sulfo-6-nitrobenzotriazole silver, 4-carboxy-6-nitrobenzotriazole silver, 5-carboxy-6-nitrobenzotriazole silver, 4-carbamoyl-6-nitrobenzotriazole silver, 4-sulfamoyl-6-nitrobenzotriazole silver, 5-carboxymethyl-6-nitrobenzotriazole silver, 5-hydroxycarbonylmethoxy-6-nitrobenzotriazole silver, 5-nitro-7-cyanobenzotriazole silver, 5-amino-6-nitrobenzotriazole silver, 5-nitro-7-(p-nitrophenyl)benzotriazole silver, 5,7-dinitro-6-methylbenzotriazole silver, 5,7-dinitro-6-chlorobenzotriazole silver and 5,7-dinitro-6-methoxybenzotriazole silver.

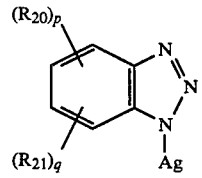

(17)

wherein $R_{20}$ is a hydroxy group, a sulfo group or a salt thereof (e.g. sodium, potassium or ammonium salt), a carboxy group or a salt thereof (e.g. sodium, potassium or ammonium salt), an optionally substituted carbamoyl group or an optionally substituted sulfamoyl group; $R_{21}$ is a halogen atom (e.g. Cl, Br or I), a hydroxy group, a sulfo group or a salt thereof (e.g. sodium, potassium or ammonium salt), a carboxy group or a salt thereof (e.g.

sodium, potassium or ammonium salt), a nitro group, a cyano group or an optionally substituted alkyl (e.g. methyl, ethyl or propyl), aryl (e.g. phenyl), alkoxy (e.g. methoxy or ethoxy) or amino group; p is 1 or 2; q is an integer of 0 to 2.

Illustrative substituents on the carbamoyl group as $R_{20}$ include methyl, ethyl and acetyl groups; illustrative substituents on the sulfamoyl group include methyl, ethyl and acetyl groups. Illustrative substituents on the alkyl group as $R_{21}$ include carboxy and ethoxycarbonyl groups; illustrative substituents on the aryl group include sulfo and nitro groups; illustrative substituents on the alkoxy group include carboxy and ethoxycarbonyl groups; and illustrative substituents on the amino group include acetyl, methanesulfonyl and hydroxy groups.

Specific examples of the organic silver salts of formula (17) shown above include the following compounds:

4-hydroxybenzotriazole silver, 5-hydroxybenzotriazole silver, 4-sulfobenzotriazole silver, 5-sulfobenzotriazole silver, benzotriazole silver-sodium-4-solfonate, benzotriazole silver-sodium-5-sulfonate, benzotriazole silver-potassium-4-sulfonate, benzotriazole silver-potassium-5-sulfonate, benzotriazole silver-ammonium-4-sulfonate, benzotriazole silver-ammonium-5-sulfonate, 4-carboxybenzotriazole silver, 5-carboxybenzotriazole silver, benzotriazole-silver-sodium 4-carboxylate, benzotriazole silver-sodium 5-carboxylate, benzotriazole silver-potassium 4-carboxylate, benzotriazole silver-potassium 5-carboxylate, benzotriazole silver-ammonium-4-carboxylate, benzotriazole silver-ammonium 5-carboxylate, 5-carbamoyl benzotriazole silver, 4-sulfamoyl benzotriazole silver, 5-carboxy-6-hydroxybenzotriazole silver, 5-carboxy-7-sulfobenzotriazole silver, 4-hydroxy-5-sulfobenzotriazole silver, 4-hydroxy-7-sulfobenzotriazole silver, 5,6-carboxybenzotriazole silver, 4,6-dihydroxybenzotriazole silver, 4-hydroxy-5-chlorobenzotriazole silver, 4-hydroxy-5-methylbenzotriazole silver, 4-hydroxy-5-methoxybenzotriazole silver, 4-hydroxy-5-nitrobenzotriazole silver, 4-hydroxy-5-cyanobenzotriazole silver, 4-hydroxy-5-aminobenzotriazole silver, 4-hydroxy-5-acetamidobenzotriazole silver, 4-hydroxy-5-benzenesulfonamidobenzotriazole silver, 4-hydroxy-5-hydroxycarbonylmethoxybenzotriazole silver, 4-hydroxy-5-ethoxycarbonylmethoxybenzotriazole silver, 4-hydroxy-5-carboxymethylbenzotriazole silver, 4-hydroxy-5-ethoxycarbonylmethylbenzotriazole silver, 4-hydroxy-5-phenylbenzotriazole silver, 4-hydroxy-5-(p-nitrophenyl)benzotriazole silver, 4-hydroxy-5-(p-sulfophenyl)benzotriazole silver, 4-sulfo-5-chlorobenzotriazole silver, 5-sulfo-5-methylbenzotriazole silver, 4-sulfo-5-methoxybenzotriazole silver, 4-sulfo-5-cyanobenzotriazole silver, 4-sulfo-5-aminobenzotriazole silver, 4-sulfo-5-acetamidobenzotriazole silver, 4-sulfo-5-benzenesulfonamidotriazole silver, 4-sulfo-5-hydroxycarbonylmethoxybenzotriazole silver, 4-sulfo-5-ethoxycarbonylmethoxybenzotriazole silver, 4-hydroxy-5-carboxybenzotriazole silver, 4-sulfo-5-carboxymethylbenzotriazole silver, 4-sulfo-5-ethoxycarbonylmethylbenzotriazole silver, 4-sulfo-5-phenylbenzotriazole silver, 4-sulfo-5-(p-nitrophenyl)benzotriazole silver, 4-sulfo-5-(p-sulfophenyl)benzotriazole silver, 4-sulfo-5-methoxy-6-chlorobenzotriazole silver, 4-sulfo-5-chloro-6-carboxybenzotriazole silver, 4-carboxy-5-chlorobenzotriazole silver, 4-carboxy-5-methylbenzotriazole silver, 4-carboxy-5-nitrobenzotriazole silver, 4-carboxy-5-aminobenzotriazole silver, 4-carboxy-5-methoxybenzotriazole silver, 4-carboxy-5-acetamidobenzotriazole silver, 4-carboxy-5-ethoxycarbonylmethoxybenzotriazole silver, 4-carboxy-5-carboxymethylbenzotriazole silver, 4-carboxy-5-phenylbenzotriazole silver, 4-carboxy-5-(p-nitrophenyl)benzotriazole silver, and 4-carboxy-5-methyl-7-sulfobenzotriazole silver. These compounds may be used either alone of in combination.

The organic silver salts used in the present invention may be prepared by known techniques; an isolated form of the organic silver salt may be put to use after it is dispersed in a binder by a suitable technique, or the silver salt may be prepared within a suitable binder and put to use without isolation.

The organic silver salt is used in an amount ranging from 0.05 to 10.0 g, preferably from 0.2 to 2.0 g, per square meter of the support.

The thermally developable, light-sensitive material of the present invention may contain various additives besides the components a) to d) shown above. One such additive is a development accelerator selected from among an alkali releaser of the type shown in U.S. Pat. Nos. 3,220,846, 3,531,285, 4,012,260, 4,060,420, 4,088,496, 4,207,392, and RD Nos. 15733, 15734 and 15776; an organic acid of the type shown in Japanese Patent No. 12700/1970; the non-aqueous polar solvent compound having —CO—, —$SO_2$—or —SO—as shown in U.S. Pat. No. 3,667,959; a melt former of the type shown in U.S. Pat. No. 3,438,776; and a polyalkylene glycol of the type shown in U.S. Pat. No. 3,666,477 and Japanese Patent Application (OPI) No. 19525/1976. Another optional additive is a toning agent which may be selected from among the compounds shown in Japanese Patent Application (OPI) Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 156525/1979, 4060/1980, 4061/1980 and 32015/1980, West German Pat. Nos. 2,140,406 and 2,220,618, and U.S. Pat. Nos. 3,080,254, 3,847,612, 3,782,941, 3,994,732, 4,123,282 and 4,201,582. More specifically, these compounds are phthalazine, phthalimide, quinazoline, N-hydroxynaphthalimide, benzoxazine, naphthoxazinedione, 2,3-dihydro-phthalazinedione, 2,3-dihydro-1,3-oxazine-2,4-dione, oxypyridine, aminopyridine, hydroxyquinoline, aminoquinoline, isocarbostyryl, sulfonamide, 2H-1,3-benzothiazine -2,4-(3H)dione, benzotriazine, mercaptotriazole, dimercaptotetrazpentalene, phthalic acid, naphthalic acid and phthalamic acid. One or more of these compounds may be mixed with an imidazole compound. Alternatively, at least one compound such as phthalic acid or naphthalic acid or an anhydride thereof may be mixed with a phthalazine compound. If desired, combinations of phthalazine and an acid such as maleic acid, itaconic acid, quinolic acid or gentisic acid may also be used as a toning agent. Also effective are the 3-amino-5-mercapto-1,2,4-triazoles and 3-acylamino-5-mercapto-1,2,4-triazoles shown in Japanese Patent Application Nos. 73215/1982 and 76838/1982.

A third optional additive is an antifoggant which may be selected from among the compounds shown in Japanese Patent Publication No. 11113/1972, Japanese Patent Application (OPI) Nos. 90118/1974, 10724/1974, 97613/1974, 101019/1975, 130720/1974, 123331/1975, 47419/1976, 57435/1976, 78227/1976, 104338/1976, 19825/1978, 20923/1978, 50725/1976, 3223/1976, 42529/1976, 81124/1976, 51821/1979 and 93149/1980, British Pat. No. 1,455,271, U.S. Pat. Nos. 3,885,968, 3,700,457, 4,137,079, 4,138,265, and West German Pat. No. 2,617,907. These compounds are mercuric salts, oxidizing agents (e.g. N-halogenacetamide, N-halogenosuccinimide, perchloric acid, salts thereof, inorganic peroxides and persulfates), acids and salts thereof (e.g. sulfinic acid, lithium laurate, rosin, diterpenic acid and thiosulfonic acid), sulfur-containing compounds (e.g. compounds that release mercapto compounds, thiouracil, disulfide, elemental sulfur, mercapto-1,2,4-triazole, thiazolinethione and polysulfide compounds), as well as oxazoline, 1,2,4-triazole and phthalimide.

A stabilizer may also be incorporated in the thermally developable, light-sensitive material of the present invention. It may be used to prevent print-out after processing. Suitable stabilizers include the hydrocarbon halides of the type shown in Japanese Patent Application (OPI) Nos. 45228/1973, 119624/1975, 120328/1975 and 46020/1978. Spcifically, they are tetrabromobutane, tribromoethanol, 2-bromo-2-tolylacetamide, 2-bromo-2-tolysulfonylacetamide, 2-tribromomethylsulfonylbenzothiazole and 2,4-bis(tribromomethyl)-6-methyltriazine.

The sulfur-containing compounds of the type shown in Japanese Patent Publication No. 5393/1971, Japanese Patent Application (OPI) Nos. 54329/1975 and 77034/1975 may also be used as post-processing agents.

The thermally developable, light-sensitive material of the present invention may further contain an isothiuronium stabilizer precursor of the type shon in U.S. Pat. Nos. 3,301,678, 3,506,444 3,824,103 and 3,884,788, or an activator stabilizer precursor of the type shown in U.S. Pat. Nos. 3,669,670, 4,012,260 and 4,060,420.

Other additives that may be incorporated in the thermally developable, light-sensitive material of the present invention are a spectral sensitizing dye, an anti-halation dye, a brightener, a hardener, an antistatic agent, a plasticizer, an extender or a coating aid.

The layer that contain the components a) to d) shown shown above and other necessary layers according to the present invention can be coated to a wide variety of supports. Illustrative supports that may be used in the present invention include plastic films such as cellulose nitrate film, cellulose ester film, poly (vinylacetal) film, polyethylene film, polyethylene terephthalate film and polycarbonate film, glass, papers such as baryta paper, resincoated paper and water-proof paper, and metals such as aluminum.

In addition to the light-sensitive layer, the thermally developable, light-sensitive material of the present invention may include a polymer overcoat, a subbing layer, a backing layer, an intermediate layer, a filter layer or any other layer that may be properly selected depending upon the need.

An image of high density and contrast may be produced from the thermally developable, light-sensitive material of the present invention by its imagewise exposure and heat development. Particularly advantageous results are obtained when the thermally developable, light-sensitive material of the present invention is used in diffusion transfer color photography, wherein heat development following imagewise exposure produces an imagewise distribution of a heat-transferable dye or its precursor from a specific color providing material, and at least a portion of said imagewise distribution is heat-transferred to an image-receiving layer which is in a superimposed relation with the thermally developable, light-sensitive material. If the material of the present invention is processed by this procedure, an image of high contrast is obtained on the image-receiving layer. While the thermally developable, color light-sensitive material of the present invention provides a dye image by imagewise exposure and heat development, the image may be heat transferred onto the image-receiving layer with the aid of a solvent (e.g. methanol, ethyl acetate, diisobutyl ketone, tri-n-cresyl phosphate or n-butyl phthalate) or a melt former that fuses with heat (e.g. methyl anisate) Alternatively, the heat transfer technique shown in British Pat. No. 1,590,957 may be used.

The image-receiving layer that is used effectively with the present invention is made of a material that is capable of receiving the dye released or formed from the color providing material during or after the thermal development. An example is a polymer that contains a tertiary amine or quaternary ammonium salt which may be of the type shown in U.S. Pat. No. 3,709,690. An illustrative polymer that contains an ammonium salt is a polystyrene-co-N,N,N-tri-n-hexyl-N-vinyl-benzyl ammonium chloride whose comonomer ratio ranges from 1:4 to 4:1, with the 1:1 ratio being preferred. A suitable polymer that contains a tertiary amine is polyvinyl pyridine. A typical image-receiving layer for use in diffusion transfer is prepared by mixing the polymer containing an ammonium salt or tertiary amine with gelatin or poly(vinyl alcohol), and applying the mixture onto a transparent support. Another useful dye-receiving material is a heat-resistant organic polymeric material having a glass transition point of 40° C. or more and which is shown in Japanese Patent Application (OPI) No. 20725/1982. This polymer may be used either as an image-receiving layer carried on a support or as the support per se.

Examples of the heat-resistant organic polymeric material shown above include polystyrene of a molecular weight in the range of 2,000 to 85,000, polystyrene derivatives having a substituent of not more than 4 carbon atoms, polyvinyl cyclohexane, polydivinylbenzene, plyvinyl pyrrolidone, polyvinyl carbazole, polyallyl benzene, polyvinyl alcohol, polyacetals such as polyvinyl formal and polyvinyl butyral polyvinyl chloride, chlorinated polyethylene, poly(ethylene trichloride fluoride), polyacrylonitrile, poly-N,N-dimethyl allylamide, polyesters such as polyacrylate having a p-cyanophenyl group, pentachlorophenyl group or 2,4-dichlorophenyl group, polyacrylchloroacrylate, polymethyl methacrylate, polyethyl methacrylate, polypropyl methacrylate, polyisopropyl methacrylate, polyisobutyl methacrylate, poly-tert-butyl methacrylate, polycyclohexyl methacrylate, polyethylene glycol dimethacrylate, poly-2-cyano-ethyl methacrylate and polyethylene terephthalate, polycarbonates such as polysulfone and bisphenol A polycarbonate, polyanhydrides, polyamides and cellulose acetates. Also useful are synthetic polymers having glass transition points of not more than 40° C. and which are of the type shown in "polymer Handbook", 2nd ed. by J. Brandrup and E. H. Immergut, John Wiley & Sons. These polymeric materials may be used either as homopolymers or as copolymers.

Particularly useful polymers include cellulose acetates such as cellulose triacetate and diacetate; polyamides based on the combination of heptamethylenediamine and terephthalate acid, fluorene dipropylamine and adipic acid, hexamethylenediamine and diphenic acid, or hexamethylenediamine and isophthalic acid; polyesters based on the combination of diethylene glycol and diphenylcarboxylic acid or bis-p-carboxyphenoxybutane and ethylene glycol; polyethylene terephthalate; and polycarbonates. These polymers may be modified; for example, polyethylene terephthalate modified with cyclohexanedimethanol, isophthalic acid, methoxypolyethyleneglycol, or 1,2-dicarbomethoxy-4-benzenesulfonic acid may be effectively used.

The polymers shown above may be used both as a support and as an image-receiving layer. When they are used as such image-receiving element, the support may be composed either of a single layer or of more than one layer. Furthermore, the support may form a white reflective layer either within or outside of the support by means of providing a portion or layer which contains titanium white.

The image-receiving layer may be carried on a support which is made of the same material as that used in the support for carrying the light-sensitive material. In other words, glass, paper or metals may be coated with one of the organic polymeric materials shown above.

When the present invention is applied to a thermally developable, color light-sensitive material, the various polymers listed above may be used in the image-receiving layer as a mordant for the dye image formation. This image-receiving layer may form a separate image-receiving element in which it is carried on a suitable support. Alternatively, said image-receiving layer may be a single layer included as part of the thermally developable, color photographic material. If necessary, said photographic material may contain an opacifying layer (reflective layer), which is used to reflect radiation, for example, visible rays, in the amount that enables the viewing of the dye image within the image-receiving layer. The opacifying layer (reflective layer) may contain various reagents such as titanium dioxide that provide the necessary light reflection.

The image-receiving layer may be formed as a peelable type. After imagewise exposure of the thermally developable, color light-sensitive material, the image-receiving layer may be superimposed on this light-sensitive layer and the assembly is subjected to uniform heat development. Alternatively, after the thermally developable, color light-sensitive material is subjected to imagewise exposure and uniform heat development, the image-receiving layer is superimposed on the developed material, and thereafter, the assembly is heated to a temperature lower than the development temperature, thereby causing the transfer of the dye image released or formed from the color providing material.

As in the case of the thermally developable, light-sensitive layer according to the present invention, any auxiliary layer such as a protective layer, intermediate layer, subbing layer or backing layer may be prepared from its own coating solution by any known coating technique such as immersion coating, air knife coating, curtain coating, or hopper coating (as shown in U.S. Pat. No. 3,681,294). If necessary, two or more layers may be applied simultaneously by any of the methods shown in U.S. Pat. No. 2,761,791 and British Pat. No. 837,095.

Various exposure means may be used with the thermally developable, light-sensitive material of the present invention. A latent image may be obtained by imagewise exposure to radiation including visible light. Light sources used in ordinary color printing may also be used with the present invention and they include a tungsten lamp, a mercury lamp, a xenon lamp, a laser beam or light from CRT.

The originals that may be subjected to imagewise exposure include not only line images such as in mechanical drawings but also photographic images with a graded tone. Printing from the original may be by contact printing or by projection printing.

Pictures projected from video cameras or video information sent from a TV station may be directly displayed on CRT or FOT, and the image is focused and printed on the thermally developable, light-sensitive material of the present invention by contact printing or by optical lenses.

A great technical advance has been made in LEDs (light-emitting diodes) and they are increasingly used as exposure means or indicators in various devices. It is difficult to fabricate an LED that effectively produces a blue light. In order to reproduce a color image, three LEDs emitting green, red and infrared lights are prepared, and these lights sensitize three different layers that respectively provide yellow, magenta and cyan dyes. More specifically, the green-sensitive layer contains a yellow dye providing material, the red-sensitive layer contains a magenta dye providing material, and the infrared-sensitive layer contains a cyan dye providing material.

The original may be processed by a method other than direct contact or projection printing. That is, the original illuminated by a light source is read by a light-receiving device such as a photoelectric tube or CCD, fed into a memory in computer, and retrieved therefrom for subsequent processing as required. The information that has been subjected to "video processing" as above is reproduced on CRT and used as an imagewise light source. Alternatively, the processed information is directly used to activate the three LEDs to emit the necessary exposure lights.

After exposure, the latent image can be rendered visible by heating the entire surface of the light-sensitive material at between about 80° and 250° C. for a period of 0.3 to 120 seconds. The temperature for development may be adjusted within the stated range by prolonging or shortening the heating period. A particularly useful range is from about 110° to 200° C. Suitable heating means include hot plates, iron, hot rollers and the like.

A specific method for forming a color image through development of the light-sensitive material of the present invention is by the thermal diffusion transfer of a mobile heat-transferable dye. In order to attain this result, the thermally developable, color light-sensitive material of the present invention must have formed on a support at least one light-sensitive layer containing a silver halide, an organic silver salt, a reducing agent therefor, a color providing material which releases or forms a mobile heat-transferable dye, and a binder comprising gelatin and/or a gelatin derivative and the poly(vinyl alcohol) of the low polymerization degree specified herein. Said thermally developable, color light-sensitive material may have as its integral part an image-receiving layer capable of receiving a mobile dye afforded from said color providing material.

The advantages of the present invention will become more apparent by reading the following examples, to which the scope of the invention is by no means limited.

EXAMPLE 1

Benzotriazole (17.9 g) was dissolved in n-butyl acetate (300 ml), followed by the addition of water (300 ml). Silver nitrate (25.5 g) was dissolved in water (150 ml). The resulting solution was added to the previously prepared butyl acetate solution of benzotriazole under vigorous agitation. After 30-minute agitation, the aqueous phase was removed from the mixture, and the n-butyl acetate phase was washed with water. It was then washed with methanol and finally centrifuged to give benzotriazole silver (33.2 g). A portion (22.6 g) of the benzotriazole was added to a mixture of a 6% aqueous polyvinyl alcohol solution (600 ml) and a 6% aqueous gelatin solution (200 ml), and the reactants were mixed under agitatioh for 48 hrs. in a ball mill until a silver salt dispersion formed. An 8% aqueous polyvinyl alcohol solution was prepared in an amount of 150 ml, and in this solution, a 1% methanol solution of 3-amino-4-allyl-5-mercapto-1,2,4-triazole (14 ml), phthalazine (0.80 g), phthalic acid (1.0 g) and t-butylhydroquinone (2.1 g or 0.0125 mol) were dissolved. To the resultion solution, an 8% aqueous gelatin solution (50 ml) and 200 ml of the separately prepared silver salt dispersion were added. To the mixture, 25 ml of a silver iodobromide emulsion (particle size: 0.06 μm, silver iodide content: 4 mol %, gelatin content: 60 g per kg of the emulsion) was added, and the resulting coating solution was applied to photographic baryta paper to give a wet thickness of 55 μm, and the web was dried. Subsequently, a 3% acetone solution of diacetyl cellulose was applied to the emulsion layer to give a wet thickness of 55 μm, and the applied layer was dried to form a protective film.

Samples No. 1 to No. 13 were prepared from the same basic formulation but by varying the viscosity of a 4% solution of the polyvinyl alcohol as shown in Table 1, which also lists the degrees of saponification and polymerization of each of the polyvinyl alcohols used in the preparation of the respective samples.

The samples were given an exposure of 3,000 CMS through a step wedge, and subsequently heat-developed at 150° C. for 20 seconds. The results are shown in Table 1 below.

Table 1 shows that when the polyvinyl alcohol to be used in combination with gelatin had viscosities within the range specified by the present invention, not only could fog be prevented but also dye images having high maximum density were obtained. These results were not dependent on the degree of saponification or polymerization of the polyvinyl alcohol.

EXAMPLE 2

To an 8% aqueous solution of polyvinyl alcohol (150 ml), 8.6 g (0.0125 mol) of color providing material sample 79 and 15 g of 1,2-cyclohexanediol were added, and the components were mixed for 24 hours under agitation in a ball mill. To the resulting mixture, a 1% methanol solution of 3-amino-4-allyl-5-mercapto-1,2,4-triazole (14 ml), phthalazine (0.80 g), phthalic acid (1.0 g) and sodium 4-diethylamino-2-methylphenylsulfamate (3.5 g or 0.0125 mol) were added. Further, 50 ml of an 8% aqueous gelatin solution and 200 ml of a silver salt dispersion the same as prepared in Example 1 were added. The mixture was supplemented with 25 ml of an iodobromide silver emulsion (particle size: 0.06 μm, silver iodide content: 4 mol %, gelatin content: 60 g per kg of the emulsion), and the resulting coating solution was spread onto phtographic baryta paper to give a wet thickness of 55 μm, and the web was subsequently dried. Samples No. 14 to No. 29 were then prepared from the same basic formulation but by varying the viscosity of a 4% solution of the polyvinyl alcohol as shown in Table 2, which also lists the degrees of saponification and polymerization of each of the polyvinyl alcohols used in the preparation of the respective samples.

The samples were given an exposure of 3,000 CMS through a step wedge, superimposed on an image-receiving layer, and developed by heating at 170° C. for 1 minute. The image-receiving layer consisted of a polyethylene terephthalate base (100 μm thick) with a vinylidene chloride coat (dry thickness: 5 μm). After the

TABLE 1

| Sample | Viscosity of 4% polyvinyl alcohol sol. (20° C.) (cps) | Degree of saponification (%) | *Degree of polymerization | Dmin | Dmax | Remarks |
|---|---|---|---|---|---|---|
| 1 | 56.5 | 98.5 | 2400 | 0.11 | 0.30 | outside of the present invention |
| 2 | 35.8 | 98.5 | 1750 | 0.12 | 0.32 | outside of the present invention |
| 3 | 10.7 | 98.5 | 1000 | 0.11 | 0.38 | outside of the present invention |
| 4 | 5.7 | 98.5 | 550 | 0.12 | 1.05 | according to the present invention |
| 5 | 3.4 | 98.0 | 300 | 0.10 | 1.35 | according to the present invention |
| 6 | 50.1 | 88.0 | 2400 | 0.15 | 0.33 | outside of the present invention |
| 7 | 32.2 | 88.0 | 1700 | 0.14 | 0.35 | outside of the present invention |
| 8 | 8.8 | 88.0 | 1000 | 0.10 | 0.55 | outside of the present invention |
| 9 | 5.1 | 88.0 | 550 | 0.12 | 1.02 | according to the present invention |
| 10 | 3.4 | 87.4 | 360 | 0.11 | 1.37 | according to the present invention |
| 11 | 3.0 | 88.2 | 260 | 0.12 | 1.58 | according to the present invention |
| 12 | 31.3 | 80.0 | 2100 | 0.08 | 0.28 | outside of the present invention |
| 13 | 3.3 | 80.0 | 350 | 0.13 | 1.60 | according to the present invention |

*The degree of polymerization was the viscosity average polymerization degree as measured by the "Method of Testing Polyvinyl Alcohol" in JIS K 6726.

development, the polyethylene terephthalate base was separated from each sample and checked for the color density of the heat-transferred image. The results are shown in Table 2 below.

TABLE 2

| Sample | Viscosity of 4% polyvinyl alcohol sol. (20° C.) (cps) | Degree of saponification (%) | *Degree of polymerization | Dmin** | Dmax** | Remarks |
|---|---|---|---|---|---|---|
| 14 | 56.5 | 98.5 | 2400 | 0.10 | 0.18 | outside of the present invention |
| 15 | 35.8 | 98.5 | 1750 | 0.12 | 0.20 | outside of the present invention |
| 16 | 10.7 | 98.5 | 1000 | 0.11 | 0.15 | outside of the present invention |
| 17 | 7.2 | 98.5 | 760 | 0.12 | 0.23 | outside of the present invention |
| 18 | 5.7 | 98.5 | 550 | 0.12 | 0.62 | according to the present invention |
| 19 | 3.4 | 98.0 | 300 | 0.08 | 0.80 | according to the present invention |
| 20 | 50.1 | 88.0 | 2400 | 0.08 | 0.12 | outside of the present invention |
| 21 | 31.2 | 80.0 | 2100 | 0.12 | 0.14 | outside of the present invention |
| 22 | 32.2 | 88.0 | 1700 | 0.11 | 0.20 | outside of the present invention |
| 23 | 16.1 | 88.0 | 1500 | 0.12 | 0.14 | outside of the present invention |
| 24 | 8.8 | 88.0 | 1000 | 0.12 | 0.30 | outside of the present invention |
| 25 | 5.1 | 88.0 | 550 | 0.14 | 0.68 | according to the present invention |
| 26 | 5.3 | 81.5 | 550 | 0.08 | 0.72 | according to the present invention |
| 27 | 3.4 | 87.4 | 360 | 0.09 | 0.88 | according to the present invention |
| 28 | 3.1 | 80.0 | 350 | 0.09 | 0.78 | according to the present invention |
| 29 | 3.0 | 88.2 | 260 | 0.12 | 0.85 | according to the present invention |

*The degree of polymerization was the viscosity average polymerization degree as measured by the "Method of Testing Polyvinyl Alcohol" in JIS K 6726.
**Dmin and Dmax were both transmission densities as measure with red light.

Table 2 shows that when the polyvinyl alcohol to be used in combination with gelatin had viscosities within the range defined by the present invention, not only could fog be prevented but also dye images having high transfer density were obtained.

The procedure of Example 2 was repeated except that half of the gelatin was replaced by phthalated gelatin. The results were the same as those listed in Table 2.

EXAMPLE 3

The polyvinyl alcohol samples used in Example 2 were checked for their miscibility with gelatin. The method of the experiment was as follows. Aqueous solutions (10%) of gelatin and each of the polyvinyl alcohols to be tested were prepared and mixed in a gelatin/PVA ratio of 3:7. Each mixture was applied to a subbed polyethylene terephthalate film to give a wet thickness of 55 μm. After drying the web, the binder coat was checked, either with the naked eye or under a microscope, to see if any island formed due to phase separation. The results are shown in Table 3 below.

TABLE 3

| Sample | Viscosity of 4% polyvinyl alcohol sol. (20° C.) (cps) | Appearance of binder coat* |
|---|---|---|
| 14 | 56.5 | x |
| 15 | 35.8 | x |
| 16 | 10.7 | x |
| 17 | 7.2 | x |
| 18 | 5.7 | o |
| 19 | 3.4 | o |
| 20 | 50.1 | x |
| 21 | 31.2 | x |
| 22 | 32.2 | x |

TABLE 3-continued

| Sample | Viscosity of 4% polyvinyl alcohol sol. (20° C.) (cps) | Appearance of binder coat* |
|---|---|---|
| 23 | 16.1 | x |
| 24 | 8.8 | x |
| 25 | 5.1 | o |
| 26 | 5.3 | o |
| 27 | 3.4 | o |
| 28 | 3.1 | o |
| 29 | 3.0 | o |

*o indicates the absence of islands or the presence of only very small islands; x indicates the presence of large islands.

What is claimed is:

1. A thermally developable, light-sensitive material having at least one thermally developable, light-sensitive layer formed on a support which comprises (a) a light-sensitive silver halide, (b) an organic silver salt, (c) a reducing agent and (d) a binder, said binder containing gelatin and/or a gelatin derivative and a poly(vinyl alcohol) having a viscosity average polymerization degree of not more than 700.

2. A thermally developable, light-sensitive material according to claim 1, wherein the viscosity average polymerization degree of said poly(vinyl alcohol) is not more than 500.

3. A thermally developable, light-sensitive material according to claim 1, wherein the viscosity average polymerization degree of said poly(vinyl alcohol) is in the range of 200 to 700.

4. A thermally developable, light-sensitive material according to claim 1, wherein the degree of saponification of said poly(vinyl alcohol) is 75% or more.

5. A thermally developable, light-sensitive material according to claim 1, wherein said gelatin and/or said gelatin derivative are contained in said binder in an amount of 10 to 90 wt % to said binder.

6. A thermally developable, light-sensitive material according to claim 1, wherein said poly(vinyl alcohol) is contained in said binder in an amount of 5 to 90 wt % to said binder.

* * * * *